United States Patent [19]

Presby

[11] 4,250,676

[45] Feb. 17, 1981

[54] PANEL INTERCONNECTING AND UPHOLSTERY-RETAINING CONNECTION FOR A TUBULAR FRAME

[75] Inventor: Benedict F. Presby, Plainfield Township, Northampton County, Pa.

[73] Assignee: Knoll International Inc., New York, N.Y.

[21] Appl. No.: 943,807

[22] Filed: Sep. 19, 1978

[51] Int. Cl.[3] ..... A47G 5/00

[52] U.S. Cl. ..... 52/222; 52/239; 160/135

[58] Field of Search ..... 52/71, 222, 238, 273, 52/239; 160/135, 351, 381, 401, 393, 396, 399; 403/390, 403

[56] References Cited

U.S. PATENT DOCUMENTS

| | | | |
|---|---|---|---|
| 655,678 | 8/1900 | Allard | 160/401 |
| 3,428,108 | 2/1969 | Singer | 160/351 X |
| 3,877,191 | 4/1975 | Munsey | 52/239 X |
| 3,895,670 | 7/1975 | Bules et al. | 160/351 X |
| 3,971,182 | 7/1976 | Donahue et al. | 160/135 X |
| 4,020,604 | 5/1977 | Legler et al. | 160/351 X |
| 4,047,337 | 9/1977 | Bergstrom | 52/71 |
| 4,068,700 | 1/1978 | Legler | 160/351 |
| 4,103,465 | 8/1978 | McDonald, Jr. | 52/238 X |
| 4,104,838 | 8/1978 | Hage et al. | 160/135 X |
| 4,121,645 | 10/1978 | Behr | 160/135 |

*Primary Examiner*—Carl D. Friedman
*Attorney, Agent, or Firm*—Robert Scobey

[57] ABSTRACT

A panel interconnecting and upholstery-retaining connection for a tubular frame including a tubular insert that extends into the frame. A tubular upholstery retainer extends into the tubular insert and holds the upholstery material in place, which is sandwiched between the tubular insert and the upholstery retainer. A wedging device bears against the inside of the tubular insert and urges the insert against the tubular frame. The wedging device may carry a foot for supporting the tubular frame above a floor and a strap for interconnecting one panel with another. The upholstery retainer may include a door hinge or door catch.

15 Claims, 7 Drawing Figures

Fig. 6.
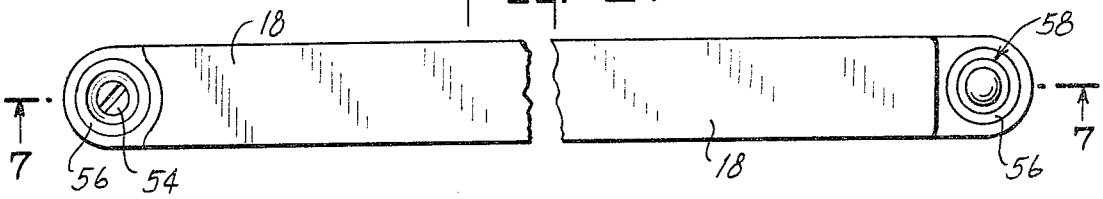
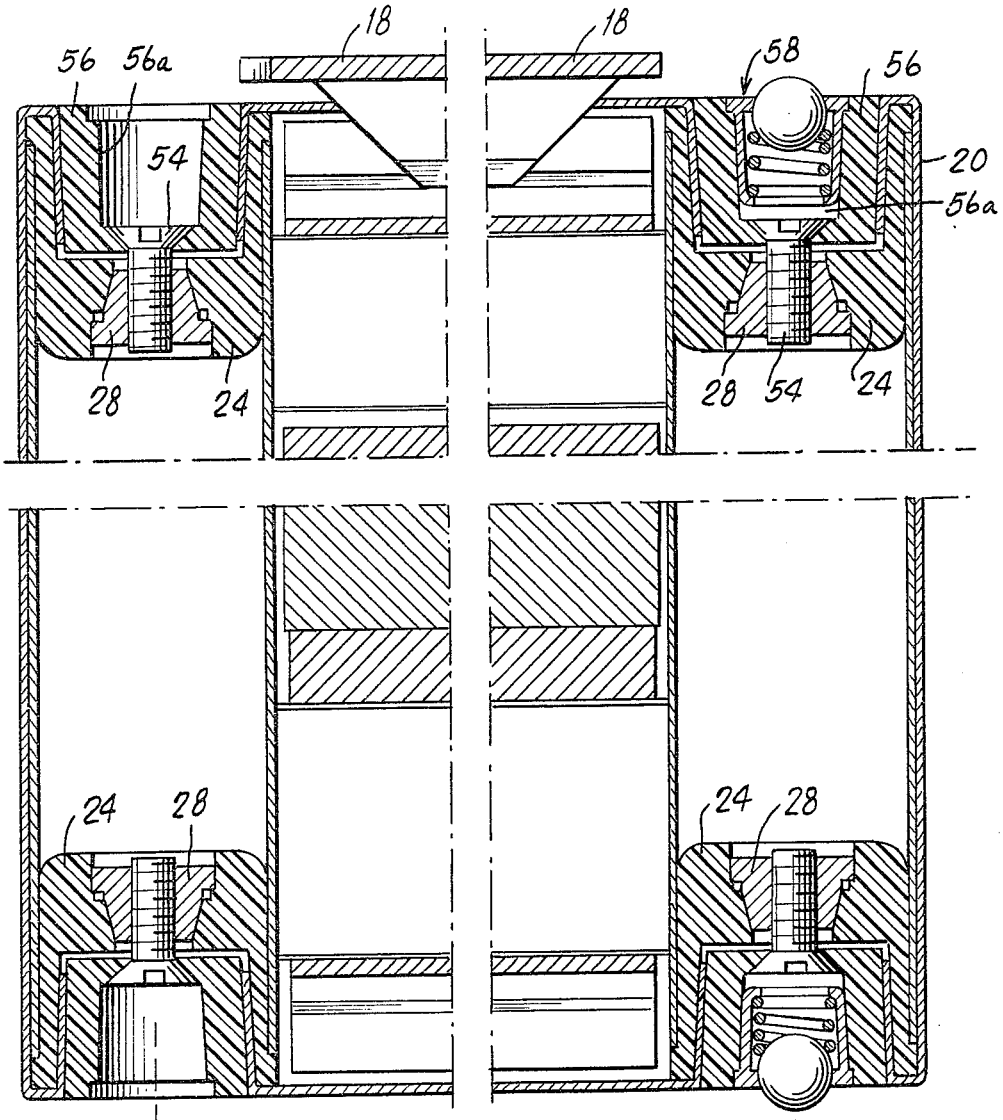
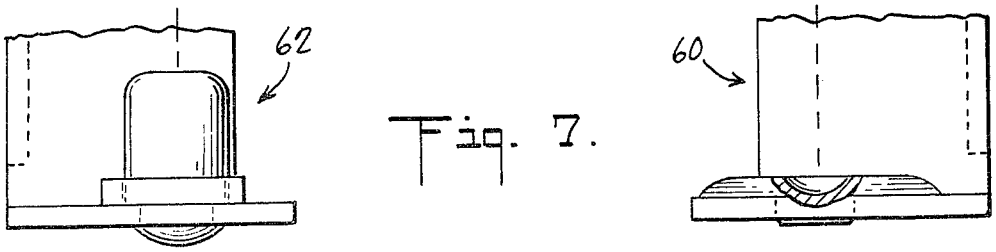
Fig. 7.

PANEL INTERCONNECTING AND UPHOLSTERY-RETAINING CONNECTION FOR A TUBULAR FRAME

BACKGROUND AND BRIEF DESCRIPTION OF THE INVENTION

This invention is directed to a panel interconnecting and upholstery-retaining connection for a tubular frame. More particularly, the invention provides such a connection for retaining upholstery around the corner post of a frame and also constituting a mechanism for supporting a door hinge, a door catch, a supporting foot for the frame, and an interconnection for easily and rapidly joining one frame to another.

This invention is particularly suited for office landscape systems in which panel structures are utilized, covered with upholstery material. There are different types of panel systems on the market, involving varying approaches to upholstery material connections, panel interconnections and hardware fastenings. Most are cumbersome and complicated to install and costly. The present invention, on the other hand, provides a panel interconnecting and upholstery-retaining connection which is simple and not costly, and easy to install and dismantle for reupholstering and connecting panels together.

In summary, a preferred embodiment of the invention involves a panel interconnecting and upholstery-retaining connection for a tubular frame that includes a tubular insert extending into the tubular frame. The insert is preferably tapered along its length so that it may be wedged into the frame. Upholstery material extends into the tubular insert, and a tubular upholstery retainer holds the material in place, with the upholstery material being sandwiched between the tubular insert and the retainer. The retainer may also be tapered to provide a wedging action in holding the upholstery material in place. A wedging device is utilized which bears against the inside of the tubular insert, urging that insert against the tubular frame. In this fashion, a simple but secure upholstery-retaining connection is provided. Additionally, the upholstery retainer may carry a door hinge or a door catch. A strap for interconnecting adjacent panels, for example, and a foot for supporting the tubular frame above a support surface, such as a floor, may be carried by the wedging device. An assembly of strap and two wedging devices and two feet advantageously constitutes a pre-assembled unit for joining together two adjacent panels.

The following patents are representative of the prior art:

| U.S. Pat. No. | Inventor | Issued |
|---|---|---|
| 3,327,440 | Watkins | 6/27/67 |
| 3,662,807 | Miller | 5/16/72 |
| 3,713,474 | Orlando | 1/30/73 |
| 3,762,116 | Anderson et al | 10/2/73 |
| 3,766,692 | Stark et al | 10/23/73 |
| 3,766,959 | Himel | 10/23/73 |
| 3,823,426 | Mitchko | 7/16/74 |
| 3,877,191 | Munsey | 4/15/75 |
| 3,987,838 | LaGue et al | 10/26/76 |
| 3,990,204 | Haworth et al | 11/9/76 |
| 4,020,604 | Legler et al | 5/3/77 |
| 4,056,903 | Guarnere | 11/8/77 |
| 4,068,700 | Legler | 1/17/78 |

The invention will be more completely understood by reference to the following detailed description.

BRIEF DESCRIPTION OF THE DRAWINGS

FIG. 6 is a top view of a panel embodying the invention.

FIG. 7 is a sectional view of the panel of FIG. 6.

DETAILED DESCRIPTION

Figure 1:
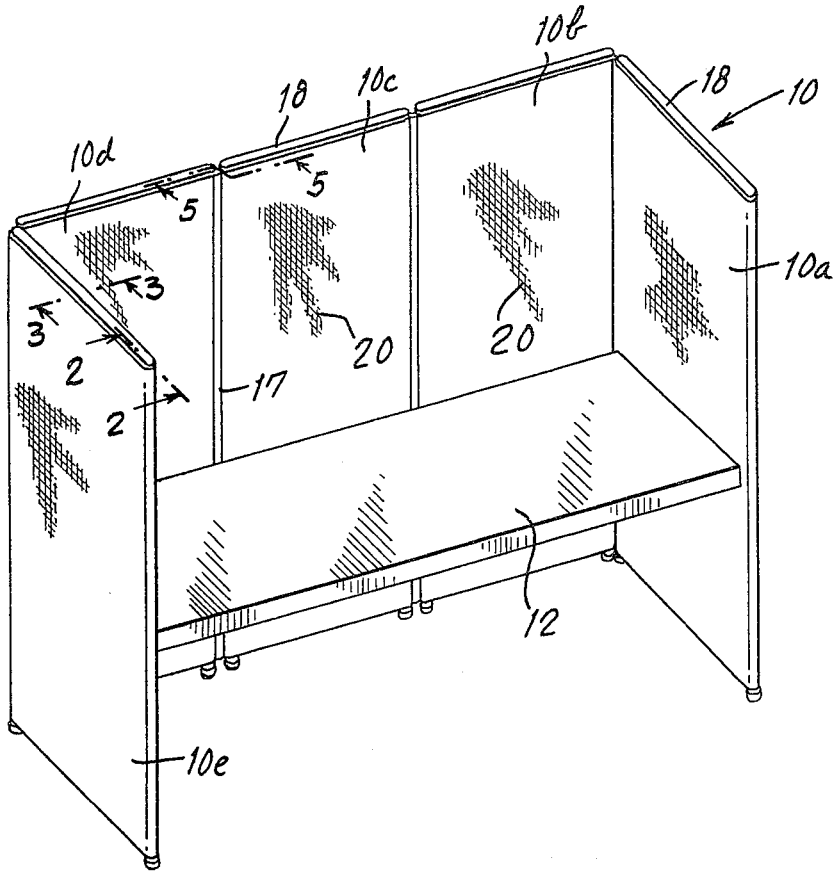
FIG. 1 is a perspective view of a panel system embodying the invention.
Figure 4:
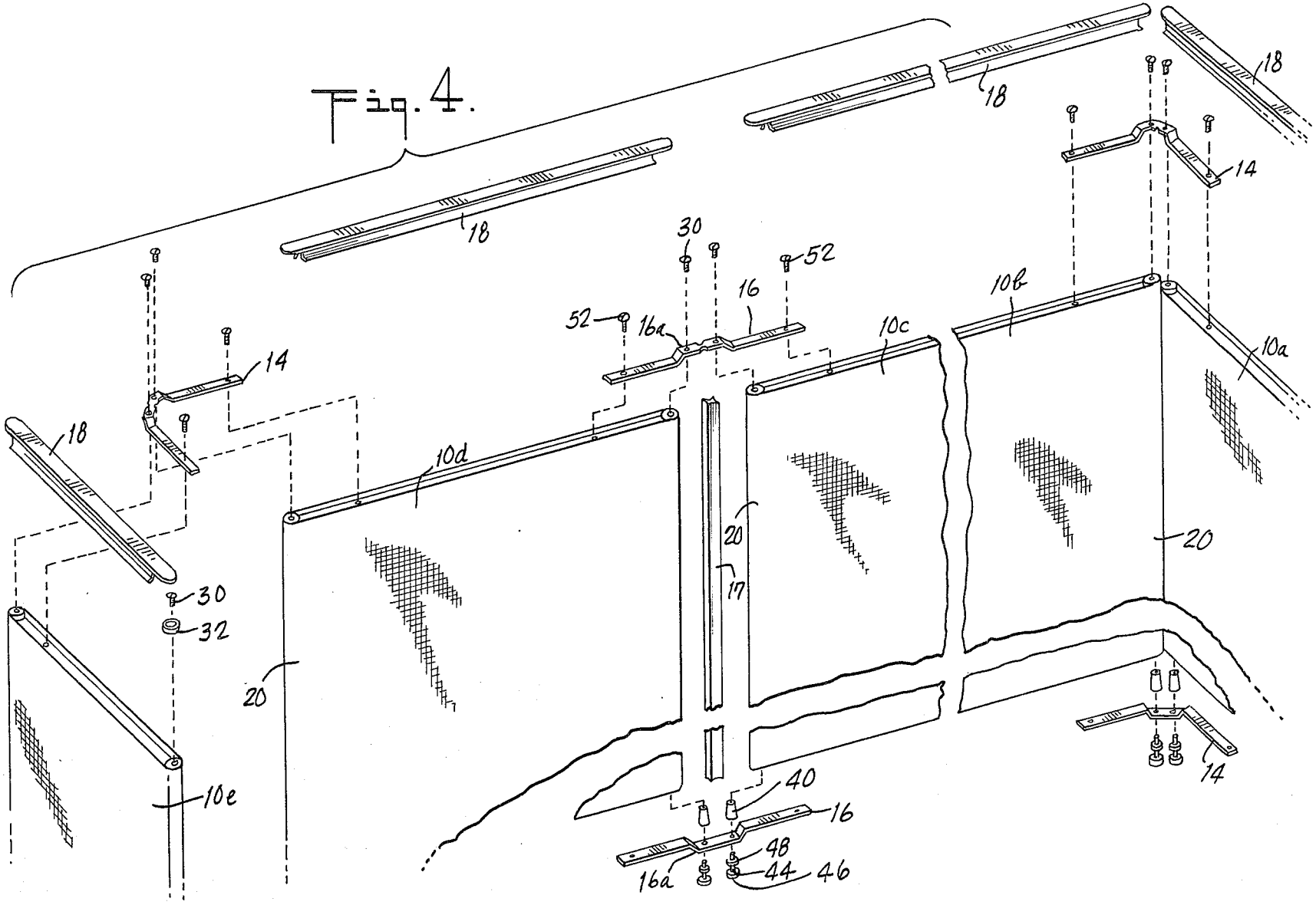
FIG. 4 is an exploded view of the system of FIG. 1.

Referring to FIG. 1, a workstation 10 is shown, formed from interconnected panels 10*a*, 10*b*, 10*c*, 10*d*, and 10*e*, as well as a working surface 12. FIG. 4 is an exploded view of the panel system 10. Corner connection elements 14 are employed to interconnect the corner panels, i.e., panels 10*a*, 10*b*, and 10*d*, 10*e*. Connection elements 16 are used to interconnect adjacent panels that essentially form a planar surface, such as adjacent panels 10*c* and 10*d*. An intermediate trim piece 17 may be employed to space apart such adjacent panels. Cap strips 18 are utilized to finish off the tops of the panels. The panels themselves are generally covered with upholstery material 20.

Figure 2:
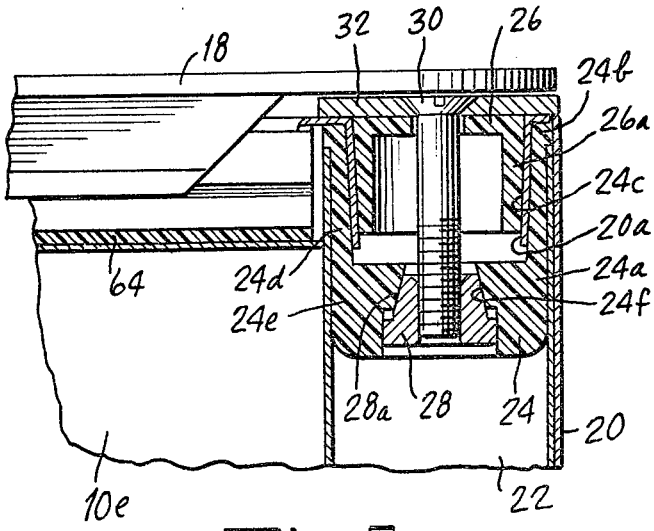
FIGS. 2, 3, and 5 are sectional views, to an enlarged scale, taken along the corresponding section of FIG. 1.

Referring now to FIG. 2, which shows a portion of the panel 10*e* (which may be taken as representative), the panel is formed of a framework which includes a tubular frame portion 22. A tubular insert 24 extends into the tubular frame 22, and is preferably formed with a tapered outer surface 24*a* so that the insert may be force fitted into the tubular frame 22. Typically, the tubular frame is made of metal, while the insert is of plastic material. The insert 24 may be capped along its upper edge by a shoulder 24*b* which rides over the upper edge of the tubular frame 22. The upper edge of the upholstery material 20 extends over the shoulder 24*b* and downwardly inside the adjacent inner surface of the tubular insert 24, as at 20*a*. A tubular upholstery retainer 26 extends into the tubular insert 24, with the upholstery material edge 20*a* sandwiched between the tubular insert 24 and the upholstery retainer. Outer surface 26*a* of the upholstery retainer may be tapered as is adjacent interior surface 24*c* of the tubular insert, so that the upholstery retainer 26 is force fitted in place, securely sandwiching the edge 20*a* of upholstery material between it and the tubular insert 24.

It is apparent from FIG. 2 that the tubular insert 24 is formed with wall portions of varying thickness, such as wall portions 24*d* and 24*e*. The upholstery material is sandwiched between the upholstery retainer 26 and the wall portion 24*d* (which is thinner than the wall portion 24*e*). The wall portion 24*e* of greater thickness includes a tapered inner surface 24*f*, against which the tapered outer surface 28*a* of a nut 28 bears. The nut 28 constitutes a wedging means that bears against the inside of the tubular insert 24 urging that insert against the tubular frame 22. To this end, a machine screw 30, held in place by a washer 32, draws the nut 28 upwardly, so that the tapered surfaces 24*f* and 28*a* bear against each other and the tubular insert is forced against the inner walls of the tubular frame 22, holding the insert rigidly in place. It will be noted that this wedging action between the tubular insert 24 and tubular frame 22 is independent of the wedging action exerted by the upholstery retainer 26 retaining the upholstery material 20 in place.

Figure 5:
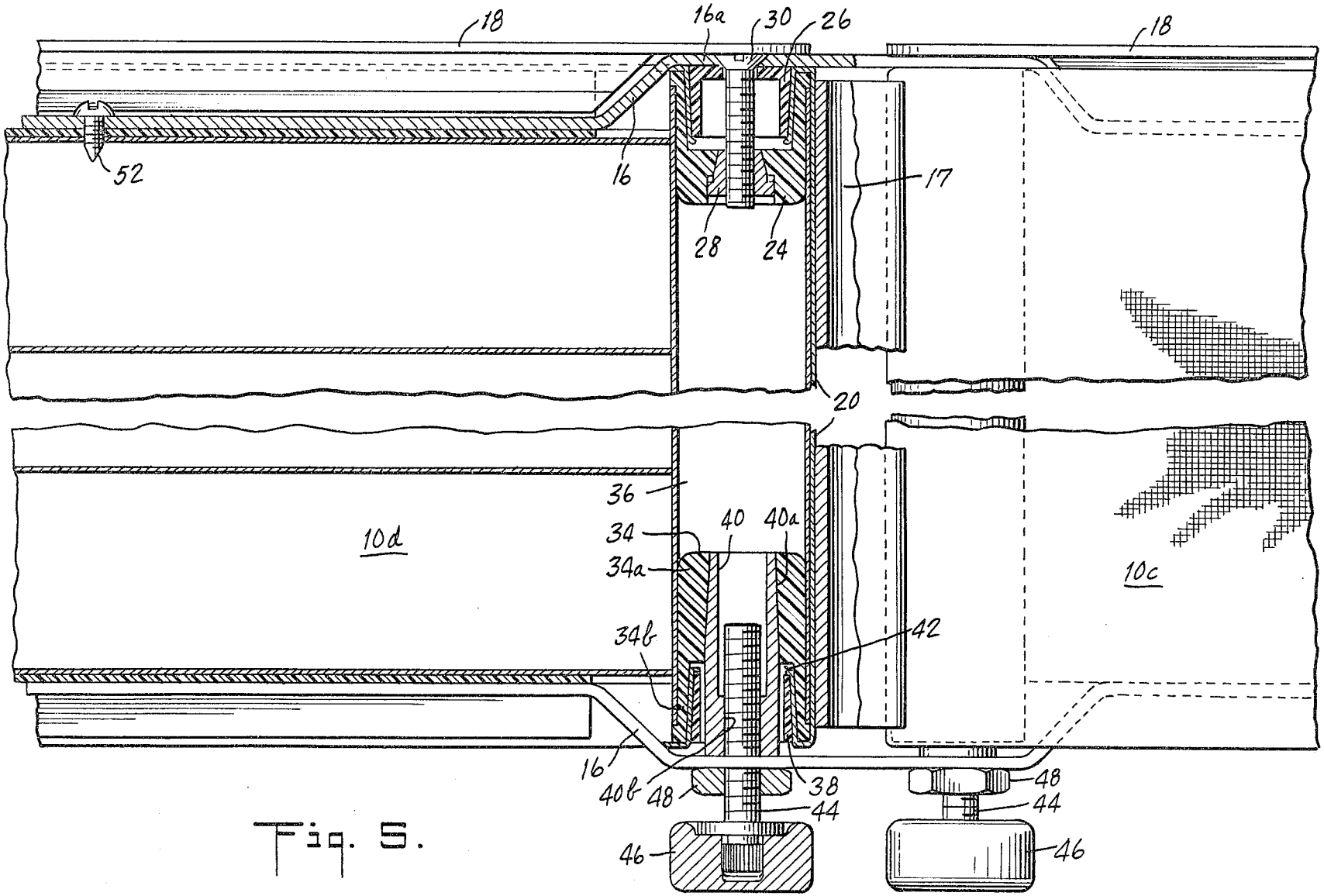

In FIG. 5, the details of the interconnection of two panels 10*c* and 10*d* are given. It is apparent from the upper portion of the figure that a tubular insert 24, an upholstery retainer 26, a tapered nut 28, and a machine screw 30 are all employed, exactly as in the end-of-panel structure shown in FIG. 2. In this case, the machine screw 30 passes through a hole 16*a* in the strap 16 used to interconnect the two panels 10*c* and 10*d*. At the bottom of the panels, a slightly different construction is used, although the principles are the same. Again, a tubular insert 34 is employed, the outer surface of which may be slightly tapered so that it may be wedged into position inside tubular frame portion 36. An upholstery retainer 38 is used to retain upholstery material 20 in place. The retainer 38 is tapered as is the retainer 26, described above. It will be noted that the tubular insert 34 includes a portion 34*a* of greater wall thickness than the portion 34*b*. In this fashion the wedging action achieved by tubular sleeve 40 against the wall portion 34*a* may be made independent of the wedging action by the upholstery retainer 38. Essentially, the wall portions 34*a* and 34*b*, of differing thicknesses, create a space 42 within which the upholstery 20 and upholstery retainer 38 may be positioned without contact with the sleeve 40.

The sleeve 40, which may be made of metal, is tapered as at 40*a* so that it exerts a wedging action against the tubular insert 34, forcing that insert against the tubular frame 36 and retaining the insert securely in place. The tubular sleeve 40 includes a threaded channel 40*b* into which a stud 44 is threaded. The stud carries a glide 46 which serves as a foot for supporting the panel above a support surface, such as a floor. Stud 44 is threaded into the sleeve 40, and locked in appropriate position by means of a lock nut 48. It should be noted that the stud 44 passes through one of the holes 16*a* in the connector 16.

It is advantageous to assemble two studs 44, each with its glide 46 and lock nut 48 and sleeve 40, along with connecting strap 16, all as one assembly. All that is necessary to join this assembly to adjacent panels is to insert the sleeves 40 into the associated inserts 34 and wedge the sleeves and inserts together. The interconnecting strap 16 at the bottom of the panels is not affixed to either panel, but simply rides in a channel formed at the bottom of each panel, which prevents the panels from pivoting. At the tops of adjacent panels, the strap 16 is typically screwed into the channel formed at the top of the panel by means of screws 52.

FIGS. 6 and 7 show the details of panel construction in which an upholstery retainer is modified to include a mechanism such as a door hinge or a door catch. In particular, with reference to the right-hand portion of FIG. 7, tubular insert 24 and wedging nut 28 are the same as shown in FIG. 2. A machine screw 54 shorter than the machine screw 30 in FIG. 2 is employed. In this case, a slightly different upholstery retainer 56 is utilized, which has the same function of sandwiching upholstery material 20 between it and the tubular insert 24. Additionally, the upholstery retainer 56 is formed with a central cavity 56*a* which contains a conventional ball assembly 58 which serves as a door catch to cooperate with catch mechanism 60 shown at the bottom, right-hand portion of FIG. 7 and which is affixed to a door (not shown). As noted, the door catch mechanism 58 and 60 is conventional, e.g., as manufactured by Tueger and Luermann of 5860 Iserlohn, Postfach 166 West Germany.

As is apparent from the left-hand portion of FIG. 7, the assembly is identical to that just described, except that in this case the upholstery retainer 56 serves to receive door hinge 62.

Figure 3:
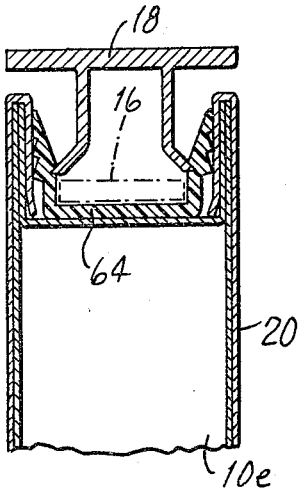

Referring to FIG. 3, the details of maintaining the cap strip 18 in place are shown. A channel member 64 is employed bearing against the upholstery material 20 and serving both to retain the upholstery material in position along the intermediate sections of the panel as well as to retain the cap strip in position.

It is apparent that the above-described preferred embodiment is subject to modification. Accordingly, the invention should be taken to be defined by the following claims.

What is claimed is:

1. An upholstery-retaining connection for a tubular frame comprising a tubular insert extending into said tubular frame, a tubular upholstery retainer extending into said tubular insert with upholstery material sandwiched between said tubular insert and said upholstery retainer, and wedging means bearing against the inside of said tubular insert urging said insert against said tubular frame.

2. A connection according to claim 1, in which at least one of said tubular insert and said upholstery retainer is tapered on the outer surface thereof along the axis thereof.

3. A connection according to claim 1 or 2, in which said tubular insert is formed with wall portions of varying thickness.

4. A connection according to claim 3, in which said upholstery material is sandwiched between said upholstery retainer and a wall portion of said tubular insert of first thickness, and said wedging means bears against a wall portion of said tubular insert of second thickness greater than said first thickness.

5. A connection according to claim 1 or 2, in which said wedging means comprises a nut having a tapered outer surface, said tubular insert including a tapered inner surface bearing against said tapered outer surface of said nut, and screw means drawing said nut and tubular insert against each other.

6. A connection according to claim 1 or 2, in which said upholstery retainer carries one of hinge means for a door and door catch means.

7. A connection according to claim 1 or 2, in which said tubular insert supports means for interconnecting one tubular frame with another.

8. A connection according to claim 1 or 2, in which said wedging means comprises a tubular sleeve carrying foot means for supporting said tubular frame.

9. A connection according to claim 8, in which said tubular insert includes a tapered inner surface and said tubular sleeve includes a tapered outer surface bearing against said tapered inner surface of said insert.

10. A connection according to claim 9, in which said tubular sleeve includes a threaded channel, and said foot means comprises a stud threaded into said channel, and a glide affixed to said stud.

11. A connection according to claim 10, including a strap for joining one panel to another held by said tubular insert.

12. A connection for joining a first tubular frame to a second tubular frame comprising first and second tubular members extending respectively and removably into said first and second tubular frames, and a strap removably connected to said tubular members, said strap extending laterally of said tubular members and including means for removably connecting said strap to said tubular frames, each of said tubular members being adapted for a force fit in the corresponding tubular frame, said force fit constituting the sole connection between said tubular members and tubular frames.

13. A connection according to claim 12, in which said tubular members and strap comprise a pre-assembled unit for joining two frames together.

14. A connection according to claim 12, in which each tubular member comprises a tubular insert wedge-fitted into the corresponding tubular frame, and a wedging part inserted into said tubular insert and urging said insert against said frame.

15. A connection for joining a first tubular frame to a second tubular frame comprising first and second tubular members extending respectively into said first and second tubular frames, and a strap connected to said tubular members, each of said tubular members being adapted for a force fit in the corresponding tubular frame, in which said tubular members and strap comprise a pre-assembled unit for joining two frames together, and in which each tubular frame includes a channel as part thereof, and said strap includes end portions positioned in said frame channels.

* * * * *